US007861764B1

(12) United States Patent
Cowan

(10) Patent No.: US 7,861,764 B1
(45) Date of Patent: Jan. 4, 2011

(54) SYSTEM FOR SUSPENDING QUILTS AND THE LIKE

(76) Inventor: Terri M. Cowan, 2051 Creekcrest Ct., Lincoln, CA (US) 95648

( * ) Notice: Subject to any disclaimer, the term of this patent is extended or adjusted under 35 U.S.C. 154(b) by 422 days.

(21) Appl. No.: 11/378,220

(22) Filed: Mar. 17, 2006

Related U.S. Application Data

(60) Provisional application No. 60/662,863, filed on Mar. 18, 2005.

(51) Int. Cl.
*A47H 13/00* (2006.01)

(52) U.S. Cl. ..... 160/383; 160/330

(58) Field of Classification Search ..... 160/330, 160/383, 387, 385, DIG. 6, 368.1, 126
See application file for complete search history.

(56) References Cited

U.S. PATENT DOCUMENTS 1,602,341 A * 10/1926 Day ..... 40/658
2,123,413 A * 7/1938 Geller ..... 160/237
2,156,231 A * 4/1939 Stam ..... 160/327
2,520,613 A * 8/1950 Robertson ..... 160/387
2,533,216 A * 12/1950 Bixer ..... 160/387
2,629,436 A * 2/1953 Hess ..... 160/348
2,640,993 A * 6/1953 Kleinman ..... 2/268
3,181,597 A * 5/1965 Levine ..... 160/348
3,182,414 A * 5/1965 Snediker ..... 40/604
3,442,319 A * 5/1969 Barbour ..... 160/330
4,437,505 A * 3/1984 Rodgers ..... 160/126
4,747,442 A * 5/1988 Bade ..... 160/348
4,945,706 A * 8/1990 Beaullieu ..... 40/606.12
4,976,301 A * 12/1990 Easley et al. ..... 160/84.01
4,986,329 A * 1/1991 Kupchunos ..... 160/84.01
4,991,245 A * 2/1991 Franco ..... 5/419
5,170,917 A * 12/1992 Tourigny ..... 224/221
5,191,922 A * 3/1993 Wade ..... 160/124
5,219,407 A * 6/1993 Herring ..... 160/330
5,230,375 A * 7/1993 Linder ..... 160/39
5,275,225 A * 1/1994 Marasco et al. ..... 160/348
5,283,909 A * 2/1994 Hill ..... 2/69
5,437,474 A * 8/1995 Ament ..... 280/749
5,733,166 A * 3/1998 Hoag ..... 446/75
5,785,188 A * 7/1998 Ogden ..... 211/88.01
5,894,876 A * 4/1999 O'Brien ..... 160/84.01
6,041,454 A * 3/2000 Summerford ..... 4/558
6,113,454 A * 9/2000 Mitchell ..... 446/227
6,119,760 A * 9/2000 Poole ..... 160/330
6,209,614 B1 * 4/2001 Smoot ..... 160/237

(Continued)

*Primary Examiner*—Katherine W Mitchell
*Assistant Examiner*—Candace L Bradford
(74) *Attorney, Agent, or Firm*—Heisler & Associates

(57) ABSTRACT

A sleeve is provided which is attachable to a back of a quilt or other object to be suspended from a rod or other elongate object. The sleeve is of generally tubular form including a front panel extending from a bottom up to a top pleat. The forward panel is coupled to the back of the quilt through top stitching adjacent the top pleat and bottom stitching adjacent the bottom. Preferably, a rear panel similar in form to the forward panel extends up from the bottom to an upper pleat. A gusset is also preferably provided between the forward panel and the rear panel with the gusset itself formed of a first panel and second panel spaced from each other by a center pleat. The forward panel has a length between the top pleat and the bottom which is less than half of an entire circumferential length of the sleeve.

15 Claims, 3 Drawing Sheets

U.S. PATENT DOCUMENTS 6,219,892 B1 * 4/2001 Johnsen ..... 24/716
6,257,422 B1 * 7/2001 Rios ..... 211/45
6,618,876 B2 * 9/2003 Murphy et al. ..... 5/53.1
6,862,823 B2 * 3/2005 deCarteret ..... 38/102
6,866,079 B2 * 3/2005 Lee ..... 160/178.1 R
7,523,778 B2 * 4/2009 Roberts et al. ..... 160/237
2002/0095725 A1 * 7/2002 Dix ..... 5/482
2004/0045684 A1 * 3/2004 Smith et al. ..... 160/348
2004/0244249 A1 * 12/2004 Zheng ..... 40/610
2005/0144695 A1 * 7/2005 Aldridge et al. ..... 2/69
2006/0175021 A1 * 8/2006 Stewart ..... 160/124
2007/0209265 A1 * 9/2007 Robb ..... 40/658

* cited by examiner

SYSTEM FOR SUSPENDING QUILTS AND THE LIKE

CROSS-REFERENCE TO RELATED APPLICATIONS

This application claims benefit under Title 35, United States Code §119(e) of U.S. Provisional Application No. 60/662,863 filed on Mar. 18, 2005.

FIELD OF THE INVENTION

The following invention relates to notions in the form of mounting structures adapted to be coupled to other textile materials for mounting. More specifically, this invention relates to sleeves particularly configured to be attachable to a back of a quilt or other planar flexible object to facilitate mounting of the object upon a rod or other elongate rigid support structure.

BACKGROUND OF THE INVENTION

Traditionally, handmade fabric rod pockets, also called "quilt sleeves," are attached to the back top edge of a quilt or wall hanging, and are the most popular way to allow the quilt or wall hanging to be hung for display. Such quilt sleeves are sized large enough to accommodate the rod to be used passing through an interior thereof. An approximately three inch to four inch tall quilt sleeve is a standard requirement on all quilts to be displayed in quilt shows, quilt guilds, and quilt competitions worldwide.

Handmade quilt sleeves consist of either a flat one-sided piece of fabric, or, the more desirable, hand constructed tubular sleeve of fabric attached to the reverse top edge of a quilt or wall hanging. Quilt sleeves of a tubular shape are desirable in that the rod may be inserted through the sleeve without touching the original quilt or wall hanging, eliminating the possibility of damage to the original quilt or wall hanging fabric. The rod only touches the inside of the quilt sleeve.

Such standard quilt sleeves tend to cause an unsightly bulge along the top edge of the front of the quilt or other wall hanging. Furthermore, to ensure that the tube size is accommodated, consideration must be made during construction to include enough fabric for the seam allowance and other sizing considerations. Hence, hand construction of such quilt sleeves is time consuming and inconvenient.

SUMMARY OF THE INVENTION

With this invention, a sleeve is provided which has already been manufactured and is ready for straightforward attachment to the back of a quilt, wall hanging or other object to be displayed. The sleeve is generally tubular in form and includes a forward panel extending between a bottom of the sleeve and a top pleat. A distance from the bottom, defining a lowermost portion of the sleeve, and the top pleat is preferably less than half of a circumferential length of the sleeve.

A user stitches the sleeve to the back of the quilt or other object through utilization of some form of a means to couple the forward panel to the quilt or other object adjacent the top pleat and some form of a means to couple the forward panel to the object adjacent the bottom. These coupling means are preferably in the form of top stitching adjacent the top pleat and bottom stitching adjacent the bottom.

Most preferably, the sleeve includes a bottom pleat at the bottom of the sleeve. Also, a rear panel is preferably provided extending from the bottom up to an upper pleat with a length of the rear panel between the bottom and the upper pleat similar to a length of the forward panel between the bottom and the top pleat. A gusset is also preferably provided between the top pleat of the forward panel and the upper pleat of the rear panel. This gusset is preferably in the form of a first panel and second panel joined together by a center pleat and with the first panel adjacent the top pleat and the second panel adjacent the upper pleat.

A circumferential length of the rear panel and the gusset together is greater than a circumferential length of the forward panel. With this arrangement, once a rod or other elongate support structure is passed through an interior of the sleeve, the quilt or other flexible planar object hangs from the sleeve in a generally planar fashion for optimal display.

OBJECTS OF THE INVENTION

Accordingly, a primary object of the present invention is to provide a suspension system for quilts and the like for suspension from an elongate structure such as a rod.

Another object of the present invention is to provide a suspension system for wall hangings which minimizes distortion of the wall hanging.

Another object of the present invention is to provide a suspension system for a quilt or other wall hanging which is easy to attach to the back of the quilt or other wall hanging.

Another object of the present invention is to provide a suspension system for suspending decorator fabric covers from curtain rods, interior casings for pull string bags or coat belts, pull backs for drapery, rugs, tapestries, other fabric art and other structures amenable to hanging on a wall or hanging from other surfaces through use of an elongate rigid structure such as a rod.

Another object of the present invention is to provide a sleeve for coupling to a back side of a quilt or other wall hanging which is suitable for delivery in both individual use and bulk roll retail delivery.

Another object of the present invention is to provide a prefabricated sleeve that need only be attached to the back of a quilt or other wall hanging for minimal distortion suspension of the quilt or other wall hanging.

Another object of the present invention is to provide a method for suspending a quilt or other wall hanging which is easy to employ and suspends the quilt or other wall hanging without distortion.

Other further objects of the present invention will become apparent from a careful reading of the included drawing figures, the claims and detailed description of the invention.

DESCRIPTION OF THE PREFERRED EMBODIMENT

Figure 1:
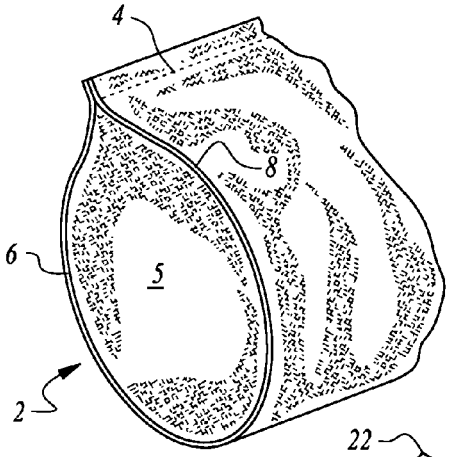
Fig. 1 (Prior Art)
FIG. 1 a perspective view of a prior art quilt sleeve.

Referring to the drawings, wherein like reference numerals represent like parts throughout the various drawing figures, reference numeral 10 is directed to a sleeve (FIGS. 2-6) which is attachable to a back B of a quilt Q or other planar flexible structure for suspension of the quilt Q from a rod R or other elongate structure. The sleeve 10 is particularly configured so that the quilt Q remains substantially flat without any undulation or other distortion adjacent where the sleeve 10 is mounted. The sleeve 10 is also configured for convenient and proper connection of the sleeve 10 to the quilt Q so that the sleeve 10 can operate in the most optimal fashion, without requiring a user to custom manufacture some form of quilt sleeve.

In essence, and with particular reference to FIGS. 2-6, basic details of the sleeve 10 of this invention are described. The sleeve 10 is generally a tubular structure formed of thin flexible fabric. The sleeve 10 includes a forward panel 20 extending from a top pleat 22 down to a bottom which is preferably defined by a bottom pleat 24. A rear panel 30 is also preferably provided as a portion of the sleeve 10. This rear panel 30 extends up from the bottom pleat 24 to an upper pleat 32. A gusset 40 is provided between the forward panel 20 and the rear panel 30. This gusset 40 spaces the upper pleat 32 of the rear panel 30 from the top pleat 22 of the forward panel 20 and completes the tubular form of the sleeve 10. The panels 20, 30 and gusset 40 are preferably all formed from the same initial planar fabric. Top stitching 50 and bottom stitching 60 is utilized to secure the forward panel 20 to the back B of the quilt Q or other object adjacent the top pleat 22 and the bottom pleat 24.

More specifically, and with particular reference to FIG. 1, details of a prior art quilt sleeve 2 are described, to provide contrast with the sleeve 10 of this invention. Standard prior art quilt sleeves 2 generally take a planar sheet of fabric and loop it into a tubular form surrounding an inside 5 by sewing the fabric back on itself at a top seam 4. A front side 6 and rear side 8 are generally provided opposite each other with the front side 6 sewn or otherwise attached to the back B of the quilt Q or other wall hanging or related object. A rod R (FIGS. 5 and 6) is then routed through the interior 5 so that the quilt Q or other wall hanging can be suspended from the rod R through the quilt sleeve 2.

Such prior art quilt sleeves 2 are deficient in that no ready indication is provided to a user as to where exactly such stitching should be provided. As a result, the stitching is generally provided adjacent the top seam 4 and adjacent a lower portion of the quilt sleeve 10 generally midway between the front side 6 and rear side 8. As a result, the rod R tends to be only tightly fit between the front side 6 and rear side 8, allowing the rod to cause a bulge visible on a front F of the quilt Q or other wall hanging. Furthermore, portions of the quilt Q above the quilt sleeve 2 are typically also distorted.

If a user attempts to compensate for this problem and makes the stitch locations too close together on the front side 6, the entire quilt Q will sag too far away from the rod R so that an opposite sagging problem is created. Compounding the difficulty of utilizing such prior art quilt sleeves 2 is the difficulty in properly sizing the quilt sleeve 2 for initial manufacture, taking into account seam allowances and other size considerations.

Figure 2:
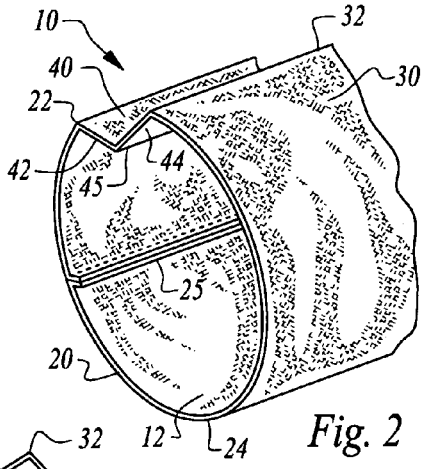
FIG. 2 is a perspective view of a portion of the sleeve according to a preferred embodiment of the suspension system of this invention.
Figure 3:
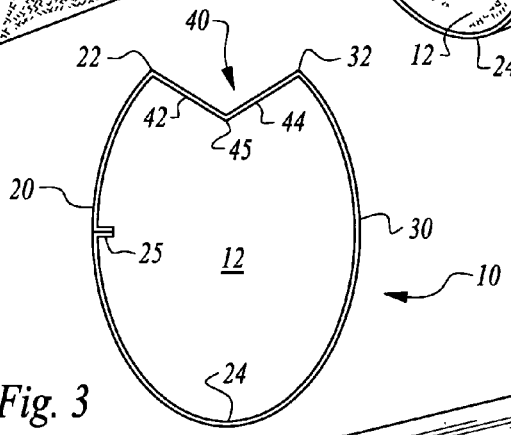
FIG. 3 is a side elevation view of that which is shown in FIG. 2.

With particular reference to FIGS. 2 and 3, basic details of the structure of the sleeve 10 of this invention, in contrast to the quilt sleeve 2 of the prior art (FIG. 1) are described according to a preferred embodiment. The sleeve 10 according to this preferred embodiment is a tubular structure preferably formed of a flexible multi-purpose fabric, such as muslin. The tube is preferably formed by taking a single sheet of the fabric material and joining it together at a seam 25. This seam 25 can initially be an overlapping seam on an exterior of the tubular sleeve 10. The sleeve 10 can then be inverted so that this seam 25 is on an interior 12 of the sleeve 10.

The sleeve 10 is preferably divided into three separate regions as it extends in length circumferentially around the interior 12. These three sections include the forward panel 20, the rear panel 30 and the gusset 40. Preferably, each of these panels 20, 30 and the gusset 40 are all formed from the same piece of fabric, but merely define different portions of the continuous sleeve 10. Alternatively, each of these panels 20, 30 and gusset 40 could be formed from two or more separate fabric or other structures having dimensions and other characteristics similar to those in the preferred embodiment formed from a single fabric material.

The forward panel 20 is initially shown curved in FIGS. 2 and 3 along its extent and at its lower edge. However, after mounting of the sleeve 10 to a quilt Q or other wall hanging or other object, the forward panel 20 is preferably adjacent the back B of the quilt Q or other wall hanging along its entire extent. This forward panel 20 extends from a top pleat 22 defining an uppermost portion of the forward panel 20 to a bottom pleat 24 defining a lowermost portion of the forward panel 20. Most preferably, the seam 25 is located somewhere between the top pleat 22 and bottom pleat 24.

The forward panel 20 could conceivably alternatively be defined at upper and lower portions thereof with lines or other demarcations other than pleats to merely identify the extent of the forward panel 20 and attachment points for coupling of the forward panel 20 to the back B of the quilt Q or other wall hanging or other object. For instance, and as shown in FIG. 3, the bottom pleat 24 is not clearly delineated, but rather only a bottom portion is provided which defines merely a lowermost portion of the sleeve 10. However, the bottom pleat 24 conveniently provides a location for attachment to the back B of the quilt Q or other wall hanging. This bottom pleat 24 is more clearly shown in FIGS. 4-6 where the bottom pleat 24 has been further exaggerated by the inclusion of bottom stitching 60 passing through both the forward panel 20 and the rear panel 30 adjacent the bottom pleat 24 and into the back B of the quilt Q.

Various different fasteners can be utilized to couple the forward panel 20 of the sleeve 10 to the back B of the quilt Q or other wall hanging. Top stitching 50 passing through the forward panel 20 adjacent the top pleat 22 and into the back B of the quilt Q provides a most preferred form of means to couple the forward panel 20 to the quilt Q or other wall hanging or other object adjacent the top pleat 22. Bottom stitching 60 provides a preferred form of means for coupling the forward panel 20 to the back B of the quilt Q or other object adjacent the bottom of the forward panel 20, such as adjacent the bottom pleat 24.

However, coupling means other than the top stitching 50 and bottom stitching 60 could be utilized. For instance, fabric adhesive or other non-fabric specific adhesives could be utilized. Alternatively, zippers, buttons, snaps, hook and eye fasteners, hook and loop fabric fasteners (such as those utilized under the trademark VELCRO) and other fasteners could be utilized. Such fasteners could be located only adjacent the top pleat 22 and bottom pleat 24 or could be continuous or otherwise arranged on the forward panel 20. Where stitching is utilized, this stitching could be that provided by a sewing machine or by hand stitching. Coupling means could be continuous along the top pleat 22 and bottom pleat 24 or could be discontinuous and only provided at discrete locations along a horizontal overall length of the sleeve 10.

A circumferential length of the forward panel 20 between the top pleat 22 and bottom pleat 24 is preferably less than half of an overall circumferential length of the sleeve 10. Thus, the attachment points at the top pleat 22 of the forward panel 20 and the bottom pleat 24 of the forward panel 20 are closer to each other along the forward panel 20 than they are to each other when measured along the rear panel 30 and gusset 40 (or analogous portions of the sleeve 10 if the rear panel 30 and gusset 40 are replated with other sleeve 10 structures in an alternative embodiment).

This sizing of the forward panel 20 causes the interior 12 of the sleeve 10 to have a certain amount of volume for accommodating the rod R therein without distortion of the quilt Q, or other object being suspended from the sleeve 10. Furthermore, the size of the forward panel 20 can be sufficiently controlled to avoid excessive sagging off of the rod R and associated distortion of the quilt Q or other object.

In a most preferred form of the invention, and to further simplify the installation process, remaining portions of the sleeve 10 are provided in the form of the rear panel 30 and gusset 40. The rear panel 30 is most preferably similar in circumferential length to the forward panel 20 as the rear panel 30 extends from the bottom pleat 24 up to an upper pleat 32. Most preferably, the rear panel 30 is a mirror image with the forward panel 20, so that the rear panel 30 and forward panel 20 could be reversed if desired. One typical distinction between the forward panel and rear panel 30 is the location of the seam 25 within the forward panel 20.

While the top stitching 50 and bottom stitching 60 have been described as passing only through the forward panel 20, in fact the bottom stitching 60 would pass through both the rear panel 30 and forward panel 20 directly adjacent the bottom pleat 24. The top stitching 50 would not pass through the rear panel 30, but rather pass through the forward panel 20 and a portion of the gusset 40 when constructed and mounted according to the most preferred embodiment of this invention.

The gusset 40 essentially provides an expansion joint within the sleeve 10 so that the forward panel 20 and rear panel 30 do not divide the sleeve 10 into two equal parts defining half of a circumferential length of the sleeve 10, but rather so that the forward panel 20 and rear panel 30 are each sized to the define less than half of the entire circumferential length of the sleeve 10. This gusset 40 is most preferably constructed to include a first panel 42 and a second panel 44 which are similar in size and spaced from each other by a center pleat 45. The center pleat 45 is preferably an interior folding pleat in contrast to the top pleat 22 and upper pleat 32, as well as the bottom pleat 24 which are outwardly folding.

Preferably, the first panel 42 and second panel 44 are sized similarly so that the entire sleeve 10 is substantially bilaterally symmetrical passing through the center pleat 45 and with a portion of the gusset 40 on either side of a centerline of the entire sleeve 10. The gusset 40 could alternatively be provided from a single panel without the center pleat 45, and merely extending from the top pleat 22 to the upper pleat 32. However, by providing the center pleat 45 the first panel 42 of the gusset 40, which is adjacent the top pleat 22 of the forward panel 20 can most easily and conveniently lay flat against the forward panel 20 and make it easiest for the top stitching 50 to be provided through the first panel 42 of the gusset 40 and the top pleat 22 of the forward panel 20, at the specified location adjacent the top pleat 22 for coupling to the back B of the quilt Q or other object.

Figure 4:
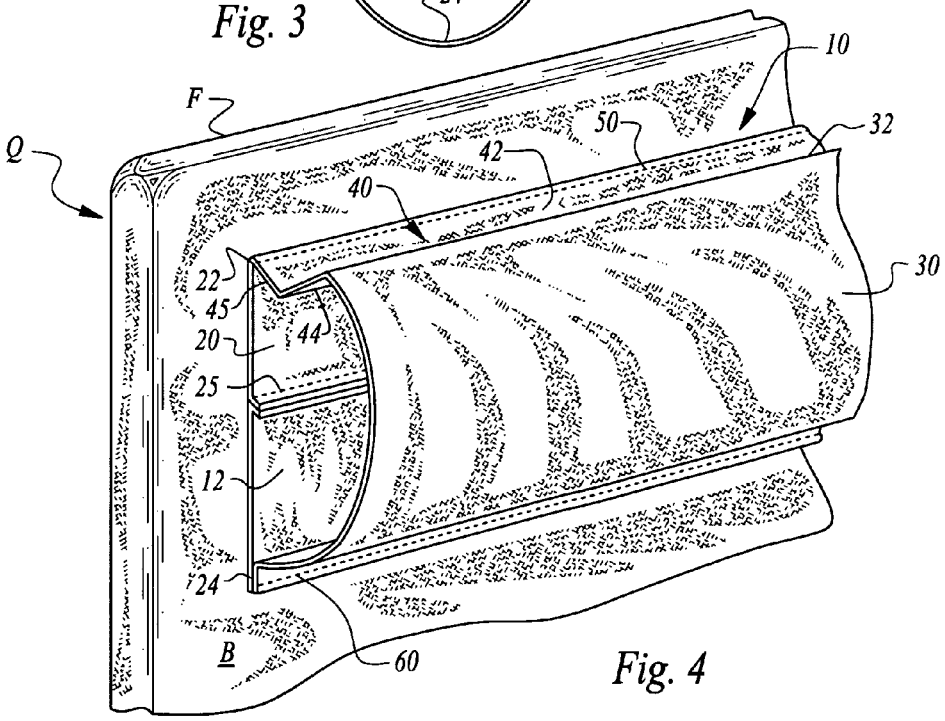
FIG. 4 is a perspective view of the sleeve of this invention, according to a preferred embodiment, shown mounted to a back side of a quilt.
Figure 5:
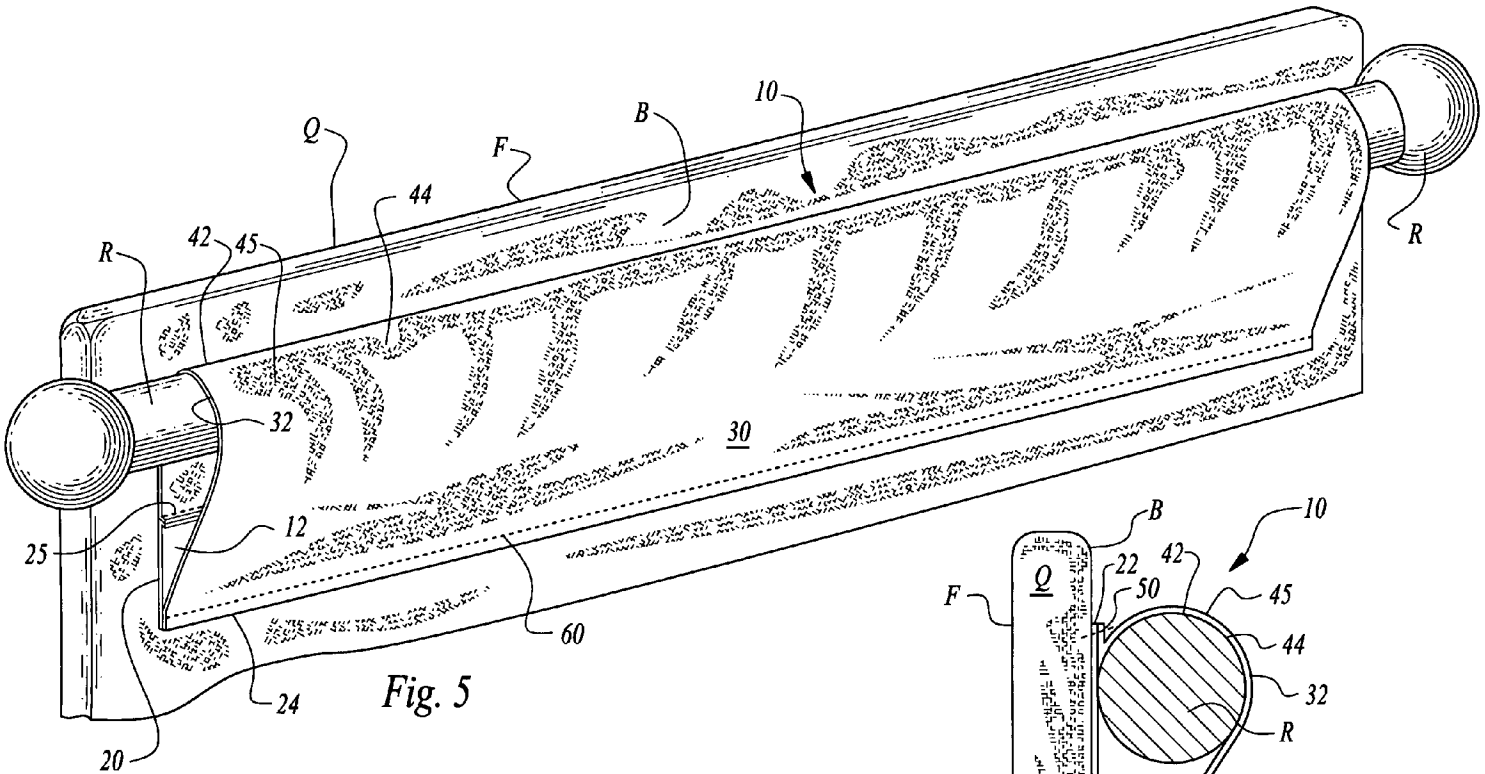
FIG. 5 is a perspective view similar to that which is shown in FIG. 4 but with a rod passing through the sleeve and showing the reconfiguration of the sleeve associated with allowing the quilt to hang from the rod through the sleeve.
Figure 6:
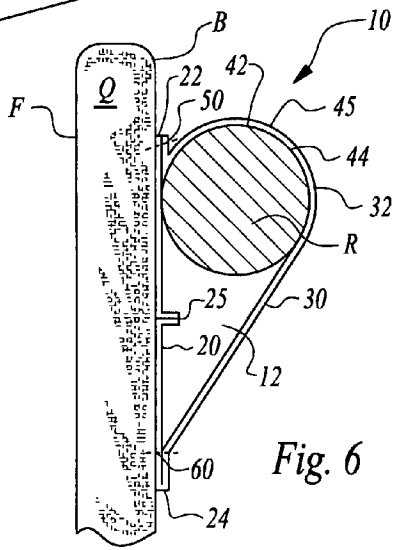
FIG. 6 is a side elevation view of that which is shown in FIG. 5 with the rod shown in section.

With the sleeve 10 configured as described above according to the preferred embodiment, and with the sleeve 10 mounted to a quilt Q, wall hanging or other object and suspended from a rod R, the final configuration of the quilt Q is generally similar to that shown in FIGS. 5 and 6. Before insertion of the rod R, the top pleat 22, upper pleat 32 and center pleat 45 are each clearly still visible (FIG. 4). The interior 12 is open and available for receiving the rod R (FIGS. 5 and 6). Once the rod R has been placed through this interior 12 and the quilt Q allowed to hang from the rod R through the sleeve 10, note that the upper pleat 32 and center pleat 45 essentially disappear. The upper pleat 32 and center pleat 45 largely disappear in that they take on the curvature of the rod R adjacent thereto.

With particular reference to FIG. 6, it is seen that the quilt Q, or other wall hanging or other object is able to be held in a substantially vertical orientation with the interior 12 accommodating the rod R easily between the rear panel 30 and forward panel 20 of the sleeve 10. This configuration is provided as a result of restricting the length of the forward panel 20 to less than half of the overall circumferential length of the sleeve 10.

A specific example for this sleeve 10 construction is provided to illustrate this feature. For instance, if the entire circumferential length of the sleeve 10 is eight inches, so that a height of the sleeve 10 when entirely flat is four inches, a gusset 40 of one-half inch depth is preferably utilized so that one inch of the entire eight inches of circumferential length is utilized within the gusset 40. In such an arrangement, the forward panel 20 is three and one-half inches long and the rear panel 30 is three and one-half inches long. A gusset 40 thus has a depth which is similar to one-seventh of a circumferential length of the forward panel 20.

Such a one-seventh ratio of the depth of the gusset 40 to the length of the forward panel 20 is most preferred. However, generally satisfactory results can be provided by varying this ratio somewhat. For instance, a ratio of gusset 40 depth to forward panel 20 length of between one-fourth and one-tenth can generally still provide somewhat adequate results, dependent partially upon the size and cross-sectional form of the rod R or other elongate support and the weight of the quilt Q or other wall hanging or other object being supported, as well as friction forces between surfaces of the sleeve 10 and the rod R or other elongate support structure, and other variables. In some instances, still further diversion outside of the general range of one-fourth to one-tenth for the ratio of gusset 40 depth to forward panel 20 length can be provided while still yielding adequate results.

Figure 7:
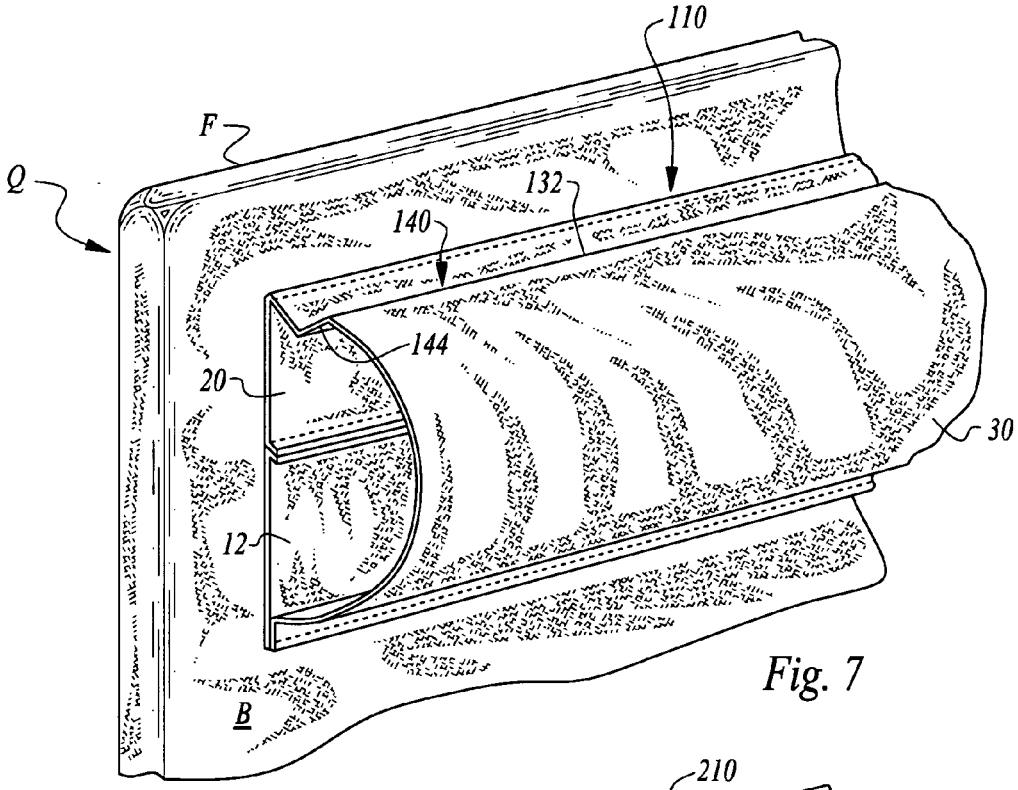
FIG. 7 is a perspective view of an alternative embodiment for the sleeve of this invention mounted to the back of a quilt and with this second embodiment showing a partially shortened gusset to make sleeve mounting to the quilt more convenient.

With particular reference to FIG. 7, an alternative sleeve 110 is shown. Portions of the alternative sleeve 110 according to this second embodiment are similar to details of the sleeve 10 (FIGS. 2-6) except where particularly described herein. In particular, the gusset 140 of the alternative sleeve 110 is non-symmetrical in this embodiment. The second panel 144 is shorter than the first panel 42 (FIG. 4) so that the upper pleat 132 (FIG. 7) of the rear panel 30 is lower than the top pleat 22 (FIG. 4).

In this alternative embodiment, the sleeve 110 can in some ways be more easily installed in that the location of the top stitching 50 (FIG. 4) is not covered by the upper pleat 132 even when the rear panel 30 lays entirely flat against the forward panel 20. Rather, the upper pleat 132 stops a little bit below the top pleat 22 (FIG. 4) so that the location for the top stitching 50 (FIG. 4) always remains exposed in this alternative embodiment of the sleeve 110. A user can thus install the stitching 50 (FIG. 4) without concern for first folding down the upper pleat 132 to gain access to the region where the top stitching 50 is to be applied.

Figure 8:
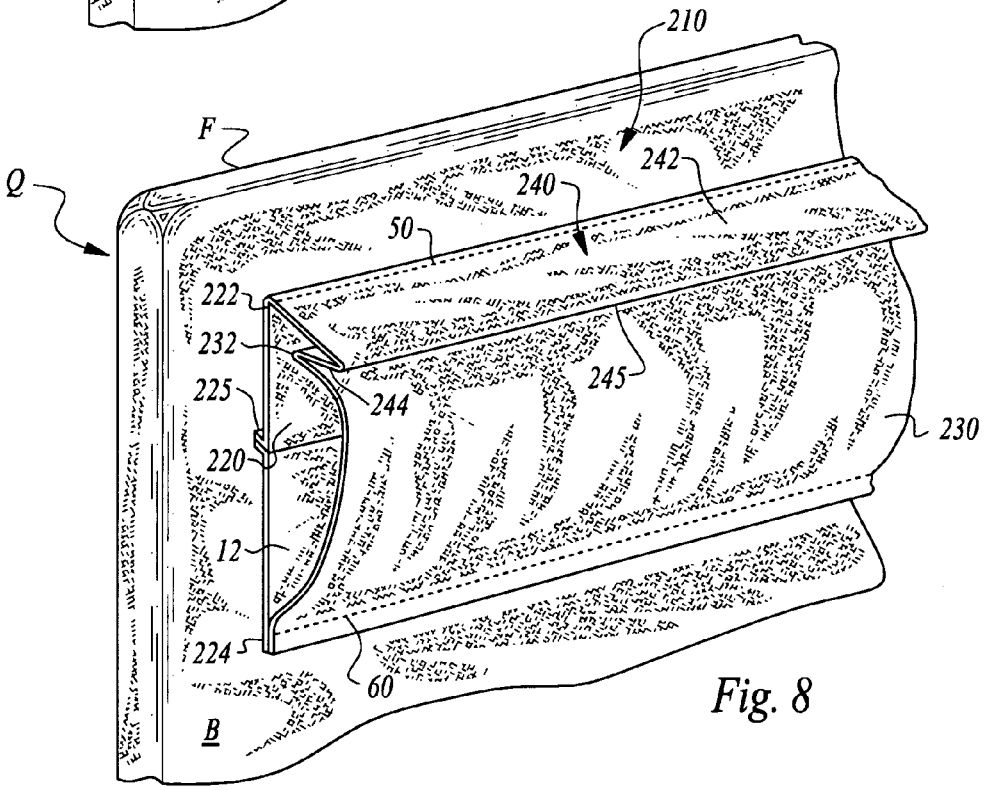
FIG. 8 is a perspective view of an alternative embodiment of the sleeve according to a third embodiment where the gusset has been modified to extend over an upper pleat of the rear panel.

With particular reference to FIG. 8, details of an alternative embodiment sleeve 210 according to a third embodiment are described. The sleeve 210 is similar to the sleeve 10 (FIGS. 2-6) except where particularly described wherein. With the alternative sleeve 210, the gusset 240 is provided so that the alternative sleeve 210 has the same general function but has a different configuration for the gusset 240 when compared to the gusset 40 (FIGS. 2-4) of the sleeve 10 of the preferred embodiment.

In particular, the gusset 240 has its center pleat 245 configured to be an outward pleat rather than an inward pleat. Also, the upper pleat 232 with this sleeve 210 has been modified so that it is now an inward pleat. The upper pleat 232 folds under the center pleat 245 tucked away under the gusset 240 with this sleeve 210. Also, the rear panel 230 is constructed to be slightly shorter than the forward panel 220. Thus, a height of the forward panel 220 between the bottom 224 and the top pleat 222 is slightly greater than a distance from the bottom pleat 224 to the upper pleat 232 on the rear panel 230.

In this way, stitching 50 can be applied adjacent the top pleat 222 and through the first panel 242 of the gusset 40 without concern for ready access to the location where the top stitching 50 is to be applied. A user need merely make sure that the top stitching 50 remains close enough to the top pleat 222 that the upper pleat 232 is not trapped by the top stitching 50. Also in this embodiment, the second panel 244 is shortened relative to the first panel 242 and the second panel 244 is tucked under the first panel 242 as it joins the center pleat 245 to the rear panel 230 at the upper pleat 232.

In this alternative embodiment sleeve 210, the seam 225 is shown outside of the interior 12 merely to show another alternative configuration for the seam 225 relative to the sleeve 10 of the preferred embodiment (FIG. 4). Also, the bottom stitching 60 is similar to that shown in other embodiments, as it passes through both the forward panel 20 and rear panel 30 adjacent the bottom pleat 224. Once the rod R (FIGS. 5 and 6) is installed within the interior 12 of both the alternative sleeve 110 and the alternative sleeve 210 (FIGS. 7 and 8) the sleeves 110, 210 will look similar to the sleeve 10 (FIGS. 5 and 6).

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A sleeve for mounting of an object on an elongate support structure passing through the sleeve, the sleeve separate and distinct from the planar object and said sleeve comprising in combination:

a forward panel extending between a top pleat and a bottom;

a rear limp panel extending between an upper pleat and said bottom;

an interior between said forward panel and said rear panel, said interior adapted to receive a rod or other elongate support structure passing therethrough;

a gusset between said top pleat and said upper pleat;

wherein said bottom includes a bottom pleat;

wherein said bottom pleat and said top pleat are adapted to be stitched to the object; and wherein a distance from said top pleat to said bottom pleat along said forward panel is shorter than a distance from said bottom pleat to said top pleat along said rear panel and said gusset.

2. The sleeve of claim 1 wherein top stitching is provided to couple said top pleat to said object and bottom stitching is provided to couple said bottom pleat to said object.

3. The sleeve of claim 1 wherein a distance from said top pleat to said bottom along said forward panel is less than a distance from said upper pleat to said bottom along said rear panel.

4. The sleeve of claim 1 wherein said gusset includes a first panel and a second panel with a center pleat between said first panel and said second panel and joining said first panel to said second panel, said first panel adjacent said top pleat and said second panel adjacent said upper pleat.

5. The sleeve of claim 4 wherein said first panel is larger than said second panel.

6. The sleeve of claim 5 wherein both said first panel and said second panel are each of a similar size.

7. The sleeve of claim 6 wherein both said first panel and said second panel are each sized about one-seventh of a length from said bottom to said top pleat along said forward panel.

8. A mounting kit for mounting a flexible planar object upon an elongate support structure, the kit comprising in combination:

a sleeve separate and distinct from the planar object and said sleeve adapted to have the elongate support structure passed therethrough;

said sleeve including a forward limp panel extending between a bottom pleat of said sleeve and a top pleat;

said sleeve including a rear panel extending from said bottom pleat to said top pleat;

wherein said bottom pleat and said top pleat are adapted to be stitched to the object;

said forward panel having a length between said bottom pleat and said top pleat less than half of a perimeter circumferential length of said sleeve;

said rear panel having a length between said bottom pleat and said top pleat greater than half of the perimeter circumferential length of said sleeve; and means for coupling said forward panel to the object substantially between said top pleat and said bottom pleat.

9. The kit of claim 8 wherein said sleeve includes a gusset between said top pleat and said upper pleat.

10. The kit of claim 9 wherein said forward panel, said rear panel and said gusset together form a circuit surrounding said sleeve.

11. The kit of claim 9 wherein said gusset includes a first panel adjacent said top pleat and a second panel adjacent said upper pleat, with a center pleat between said first panel and said second panel joining said first panel to said second panel.

12. The kit of claim 11 wherein an average length of said first panel and said second panel of said gusset is between one-fourth and one-tenth of a circumferential length of said forward panel between said bottom and said top pleat.

13. A method for suspending a flexible planar object from an elongate support structure, the method including the steps of:

providing a sleeve separate and distinct from the planar object and said sleeve including a forward limp panel extending between a bottom pleat of the sleeve and a top pleat of the sleeve, the forward panel having a length defining less than half of a perimeter circumferential length of the sleeve, the sleeve including a rear limp panel extending between the bottom pleat and the top pleat, the rear panel having a length between the bottom pleat and the top pleat greater than half of the perimeter circumferential length of the sleeve;

coupling the sleeve to the object adjacent the top pleat;

coupling the sleeve to the object adjacent the bottom pleat; and routing the elongate support structure through the sleeve, such that the flexible planar object can be suspended from the elongate support structure.

14. The method of claim 13 wherein said coupling steps each include the step of stitching the forward panel of the sleeve to the flexible planar object adjacent both the top pleat and the bottom pleat.

15. The method of claim 13 wherein said providing step includes the further steps of providing a gusset adjacent the top pleat and including the gusset along with the forward panel and the rear panel as portions of the perimeter circumferential length of the sleeve.

* * * * *